US012345410B2

(12) United States Patent
Jones

(10) Patent No.: US 12,345,410 B2
(45) Date of Patent: Jul. 1, 2025

(54) SYSTEM AND METHODS FOR CONTROLLING OPERATION OF A RECOVERY BOILER TO REDUCE FOULING

(71) Applicant: INTERNATIONAL PAPER COMPANY, Memphis, TN (US)

(72) Inventor: Andrew Kevin Jones, Cincinnati, OH (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 18/066,429

(22) Filed: Dec. 15, 2022

(65) Prior Publication Data

US 2023/0131798 A1 Apr. 27, 2023

Related U.S. Application Data

(63) Continuation of application No. 16/864,553, filed on May 1, 2020, now abandoned.

(51) Int. Cl.
*F23J 3/02* (2006.01)
*F22B 35/18* (2006.01)
(Continued)

(52) U.S. Cl.
CPC ..... *F22B 37/008* (2013.01); *F22B 35/18* (2013.01); *F23J 3/023* (2013.01); *F23J 9/00* (2013.01)

(58) Field of Classification Search
CPC .... F23J 9/00; F23J 3/023; F22B 37/38; F22B 37/56; F22B 37/008; F22B 35/18
See application file for complete search history.

(56) References Cited

U.S. PATENT DOCUMENTS 2,416,462 A 2/1947 Wilcoxson
2,819,702 A 1/1958 Koch
(Continued)

FOREIGN PATENT DOCUMENTS

AU 688683 B2 * 3/1998
CA 2387369 11/2003
(Continued)

OTHER PUBLICATIONS

Minitab, Introducing CART, 2019, https://www.minitab.com/content/dam/www/en/uploadedfiles/content/products/spm/IntroCART.pdf (Year: 2019).*

(Continued)

*Primary Examiner* — Steven S Anderson, II
(74) *Attorney, Agent, or Firm* — Thomas W. Barnes, III; Clifford R. Lamar, II

(57) ABSTRACT

In some aspects, a computer-implemented method of reducing a rate of fouling in a recovery boiler system is provided. A computing device receives boiler operating information for a period of time. The boiler operating information includes boiler operating parameters and a rate of fouling for the period of time. The boiler operating parameters include one or more boiler input parameters. The computing device performs a regression analysis to determine at least one correlation between the boiler operating parameters and the rate of fouling. The computing device causes at least one boiler input parameter to be adjusted based on the at least one correlation to minimize the rate of fouling. In some aspects, a system configured to perform such a method is provided. In some aspects, a computer-readable medium having instructions stored thereon that cause a computing device to perform such a method is provided.

20 Claims, 6 Drawing Sheets

(51) Int. Cl.

| | |
|---|---|
| ***F22B 37/00*** | (2006.01) |
| ***F22B 37/38*** | (2006.01) |
| ***F23J 9/00*** | (2006.01) |

(56) References Cited

U.S. PATENT DOCUMENTS 2,830,440 A 4/1958 Durham
2,832,323 A 4/1958 Craig
2,962,006 A 11/1960 Blodgett
2,966,896 A 1/1961 Vogler
3,028,844 A 4/1962 Durham et al.
3,040,719 A 6/1962 Dickey
3,161,180 A 12/1964 Durham et al.
3,207,134 A 9/1965 Miller
3,246,635 A 4/1966 Powell et al.
3,274,979 A 9/1966 Petit
3,291,106 A 12/1966 Palchik et al.
3,362,384 A 1/1968 Caracristi
3,364,903 A 1/1968 Covell et al.
3,436,786 A 4/1969 Rickard
3,439,376 A 4/1969 Nelson et al.
3,452,722 A 7/1969 Evers
3,575,002 A 4/1971 Vuia
3,831,561 A 8/1974 Yamamoto et al.
3,955,358 A 5/1976 Martz et al.
3,965,675 A 6/1976 Martz et al.
3,974,644 A 8/1976 Martz et al.
4,004,647 A 1/1977 Forst et al.
4,028,884 A 6/1977 Martz et al.
4,031,404 A 6/1977 Martz et al.
4,037,469 A 7/1977 Nordstrom et al.
4,085,438 A 4/1978 Butler
4,099,384 A 7/1978 Stevens et al.
4,209,028 A 6/1980 Shenker
4,237,825 A 12/1980 Kochey
4,339,998 A 7/1982 Finch
4,351,277 A 9/1982 Ryan et al.
4,359,800 A 11/1982 Ziels
4,375,710 A 3/1983 Hammond
4,377,134 A 3/1983 Frey
4,380,843 A 4/1983 Sullivan et al.
4,411,204 A 10/1983 Hamilton
4,421,067 A 12/1983 Krowech
4,422,882 A 12/1983 Nelson et al.
4,430,963 A 2/1984 Finet
4,454,840 A 6/1984 Dziubakowski
4,466,383 A 8/1984 Klatt et al.
4,475,482 A 10/1984 Moss et al.
4,488,516 A 12/1984 Bueters et al.
4,492,187 A 1/1985 Hammond
4,539,840 A 9/1985 Klatt et al.
4,552,098 A 11/1985 Wynnyckyj et al.
4,565,324 A 1/1986 Rebula et al.
4,567,622 A 2/1986 Ziels
4,599,975 A 7/1986 Reeve et al.
4,621,583 A 11/1986 Kaski
4,716,856 A 1/1988 Beisswenger et al.
4,718,363 A 1/1988 Williames
4,718,376 A 1/1988 Leroueil et al.
RE32,723 E 8/1988 Neundorfer
4,766,553 A 8/1988 Kaya et al.
4,776,301 A 10/1988 Dziubakowski
4,779,690 A 10/1988 Woodman
4,803,959 A 2/1989 Sherrick et al.
4,887,431 A 12/1989 Peet
4,920,994 A 5/1990 Nachbar
4,957,049 A 9/1990 Strohmeyer, Jr.
4,980,674 A 12/1990 Scheibel et al.
4,986,391 A 1/1991 Salmon
4,996,951 A 3/1991 Archer et al.
5,027,751 A 7/1991 Archer et al.
5,048,636 A 9/1991 Roehrs
5,050,108 A 9/1991 Clark et al.
5,063,632 A 11/1991 Clark et al.
5,065,472 A 11/1991 Carpenter et al.
5,090,087 A 2/1992 Hipple et al.
5,113,802 A 5/1992 Leblanc
5,181,482 A 1/1993 Labbe et al.
5,209,324 A 5/1993 Hogbacka
5,230,306 A 7/1993 Barringer et al.
5,237,718 A 8/1993 Brown
5,241,723 A 9/1993 Garrabrant
5,261,965 A 11/1993 Moslehi
5,267,533 A 12/1993 Smith
5,271,356 A 12/1993 Kling et al.
5,286,063 A 2/1994 Huston
5,299,533 A 4/1994 Johnston, Jr. et al.
5,305,713 A 4/1994 Vadakin
5,320,073 A 6/1994 Silcott et al.
5,348,774 A 9/1994 Golecki et al.
5,353,996 A 10/1994 Gallacher et al.
5,358,212 A * 10/1994 Soltys ..... F16K 1/526 251/210
5,365,890 A 11/1994 Johnston, Jr. et al.
5,375,771 A 12/1994 Jamelle et al.
5,379,727 A 1/1995 Kling et al.
5,398,623 A 3/1995 Lautenschlager et al.
5,416,946 A 5/1995 Brown et al.
5,423,272 A 6/1995 Dunn, Jr. et al.
5,423,483 A 6/1995 Schwade
5,429,076 A 7/1995 Johnston, Jr. et al.
5,451,002 A 9/1995 Amuny
5,477,683 A 12/1995 Persson
5,505,163 A 4/1996 Jameel
5,509,607 A 4/1996 Booher et al.
5,522,348 A 6/1996 Tanaka et al.
5,530,987 A 7/1996 Piccirillo et al.
5,549,079 A 8/1996 Johnston, Jr. et al.
5,549,305 A 8/1996 Freund
5,553,778 A 9/1996 Jameel et al.
5,605,117 A 2/1997 Moskal
5,606,924 A 3/1997 Martin et al.
5,615,734 A 4/1997 Hyp
5,619,771 A 4/1997 Minic
5,626,184 A 5/1997 Campbell et al.
5,663,489 A 9/1997 Thungstrom et al.
5,675,863 A 10/1997 Holden et al.
5,740,745 A 4/1998 Smyrniotis et al.
5,745,950 A 5/1998 Holden et al.
5,756,880 A 5/1998 Chen et al.
5,765,510 A 6/1998 Krowech et al.
5,769,034 A 6/1998 Zilka et al.
5,769,035 A 6/1998 Fiedler
5,778,830 A 7/1998 Wall
5,778,831 A 7/1998 Jameel
5,793,014 A 8/1998 Sobkowiak et al.
5,836,268 A 11/1998 Wall
5,839,396 A 11/1998 Franke et al.
5,894,806 A 4/1999 Smyrniotis et al.
5,920,951 A 7/1999 Piccirillo et al.
5,922,171 A * 7/1999 Paleologou ..... D21C 11/066 210/686
5,943,865 A 8/1999 Cohen
5,966,683 A 10/1999 Millett et al.
5,983,639 A 11/1999 Kral et al.
6,050,227 A 4/2000 LaMotte
6,065,528 A 5/2000 Fierle et al.
6,073,641 A 6/2000 Bude
6,105,590 A 8/2000 Martin et al.
6,109,096 A 8/2000 Chen et al.
6,170,117 B1 1/2001 Batt
6,178,924 B1 1/2001 Hakulinen et al.
6,244,098 B1 6/2001 Chen et al.
6,321,690 B1 11/2001 Zilka et al.
6,323,442 B1 11/2001 Jones
6,325,025 B1 12/2001 Perrone
6,425,352 B2 7/2002 Perrone
6,431,073 B1 8/2002 Zilka et al.
6,437,285 B1 8/2002 Thomas et al.
6,575,122 B2 6/2003 Hipple
6,581,549 B2 6/2003 Stewart et al.
6,604,468 B2 8/2003 Zilka et al.
6,644,201 B2 11/2003 Zilka et al.
6,681,839 B1 1/2004 Balzer

(56) References Cited

U.S. PATENT DOCUMENTS

| | | | | |
|---|---|---|---|---|
| 6,710,285 | B2 | 3/2004 | Brown et al. | |
| 6,715,499 | B2 | 4/2004 | Bartels et al. | |
| 6,715,799 | B2 | 4/2004 | Hardy | |
| 6,725,911 | B2 | 4/2004 | Jayaweera et al. | |
| 6,736,089 | B1 | 5/2004 | Lefebvre et al. | |
| 6,755,156 | B1 | 6/2004 | Zilka et al. | |
| 6,758,168 | B2 | 7/2004 | Koskinen et al. | |
| 6,764,030 | B2 | 7/2004 | Habib et al. | |
| 6,772,775 | B2 | 8/2004 | Ackerman et al. | |
| 6,782,902 | B2 | 8/2004 | Shover et al. | |
| 6,874,449 | B2 * | 4/2005 | Haaga | D21C 11/12 165/179 |
| 6,892,679 | B2 | 5/2005 | Jameel et al. | |
| 6,964,709 | B2 | 11/2005 | Matsumoto et al. | |
| 7,017,500 | B2 | 3/2006 | Jones | |
| 7,028,926 | B2 | 4/2006 | Habib | |
| 7,055,209 | B2 | 6/2006 | Zalewski | |
| 7,204,208 | B2 | 4/2007 | Johnson et al. | |
| 7,267,134 | B2 | 9/2007 | Hochstein, Jr. et al. | |
| 7,341,067 | B2 | 3/2008 | Jones et al. | |
| 7,389,151 | B2 | 6/2008 | Badami et al. | |
| 7,395,760 | B2 | 7/2008 | Zilka et al. | |
| 7,458,342 | B2 | 12/2008 | Lefebvre et al. | |
| 7,584,024 | B2 * | 9/2009 | Wroblewski | G05B 13/027 700/36 |
| 7,633,033 | B2 | 12/2009 | Thomas et al. | |
| 7,735,435 | B2 | 6/2010 | Eriksson et al. | |
| 7,789,970 | B2 | 9/2010 | Rosin | |
| 7,865,271 | B2 | 1/2011 | Booth et al. | |
| 7,922,155 | B2 | 4/2011 | Havlena | |
| 8,021,537 | B2 | 9/2011 | Sarkar et al. | |
| 8,226,777 | B2 | 7/2012 | Gaus | |
| 8,381,690 | B2 | 2/2013 | Jones | |
| 8,892,477 | B2 | 11/2014 | Radl | |
| 9,091,182 | B2 | 7/2015 | Labbe | |
| 9,541,282 | B2 | 1/2017 | Jones et al. | |
| 9,671,183 | B2 | 6/2017 | Jones | |
| 9,709,384 | B2 | 7/2017 | Menn et al. | |
| 9,915,589 | B2 | 3/2018 | Carlier et al. | |
| 10,083,767 | B2 | 9/2018 | Smith | |
| 10,161,624 | B2 | 12/2018 | Hall | |
| 10,385,513 | B2 * | 8/2019 | Koskinen | C01D 5/00 |
| 2002/0002956 | A1 | 1/2002 | Perrone | |
| 2002/0043192 | A1 | 4/2002 | Philippe et al. | |
| 2003/0047196 | A1 | 3/2003 | Bartels | |
| 2004/0006841 | A1 | 1/2004 | Jameel et al. | |
| 2004/0226758 | A1 | 11/2004 | Jones | |
| 2005/0199743 | A1 | 9/2005 | Hochstein, Jr. et al. | |
| 2005/0217544 | A1 | 10/2005 | Jones | |
| 2005/0252458 | A1 | 11/2005 | Saviharju et al. | |
| 2006/0065291 | A1 | 3/2006 | Jones et al. | |
| 2006/0236696 | A1 | 10/2006 | Saviharju et al. | |
| 2008/0090192 | A1 | 4/2008 | Dane | |
| 2009/0090311 | A1 | 4/2009 | James et al. | |
| 2009/0151656 | A1 | 6/2009 | Jones | |
| 2009/0229068 | A1 | 9/2009 | Henderson et al. | |
| 2010/0064470 | A1 | 3/2010 | Dahlen et al. | |
| 2010/0077946 | A1 | 4/2010 | D'Agostini | |
| 2010/0101462 | A1 | 4/2010 | Hayashi et al. | |
| 2010/0107636 | A1 | 5/2010 | Panchatsaram et al. | |
| 2010/0199930 | A1 | 8/2010 | Tandra | |
| 2010/0319593 | A1 | 12/2010 | Rosin | |
| 2011/0011315 | A1 | 1/2011 | Hayashi et al. | |
| 2011/0014578 | A1 | 1/2011 | Rohde et al. | |
| 2011/0067829 | A1 * | 3/2011 | Foan | D21C 3/02 162/239 |
| 2012/0270162 | A1 | 10/2012 | Dahlhielm et al. | |
| 2013/0152973 | A1 | 6/2013 | Jones | |
| 2013/0192541 | A1 * | 8/2013 | Hertweck | F22B 35/00 137/15.04 |
| 2014/0150825 | A1 | 6/2014 | Hiben et al. | |
| 2015/0253003 | A1 | 9/2015 | Jones et al. | |
| 2015/0330866 | A1 | 11/2015 | Yang et al. | |
| 2016/0025600 | A1 | 1/2016 | Carlier et al. | |
| 2019/0120481 | A1 | 4/2019 | Nagel | |
| 2019/0271464 | A1 | 9/2019 | Huang et al. | |
| 2021/0341140 | A1 | 11/2021 | Jones | |

FOREIGN PATENT DOCUMENTS

| | | | | |
|---|---|---|---|---|
| CN | 1036071 | A | 10/1989 | |
| DE | 102004030494 | A1 | 6/2013 | |
| DE | 102004030494 | B4 | 6/2013 | |
| EP | 0071815 | A2 | 2/1983 | |
| EP | 0602244 | A1 | 6/1994 | |
| EP | 0905308 | A1 | 3/1999 | |
| EP | 1063021 | A1 | 12/2000 | |
| EP | 2784477 | A1 | 10/2014 | |
| EP | 2584255 | B1 | 11/2015 | |
| GB | 802032 | A | 9/1958 | |
| GB | 1022254 | A | 3/1966 | |
| GB | 1376805 | A | 12/1974 | |
| GB | 2271440 | A | 4/1994 | |
| GB | 2428312 | A | 12/2009 | |
| JP | 62278217 | A | 12/1987 | |
| JP | H08166117 | A | 6/1996 | |
| JP | H09250708 | A | 9/1997 | |
| JP | 10274408 | A | 10/1998 | |
| JP | 2002257321 | A | 9/2002 | |
| JP | 2003156211 | A | 5/2003 | |
| JP | 2003336997 | A | 11/2003 | |
| JP | 2008146371 | A | 6/2008 | |
| JP | 2012052771 | A | 3/2012 | |
| RU | 48975 | | 8/1936 | |
| RU | 1214251 | | 2/1986 | |
| RU | 464031 | | 3/1989 | |
| RU | 2054151 | | 2/1996 | |
| WO | WO-1993005338 | A1 | 3/1993 | |
| WO | WO-1998027384 | A1 | 6/1998 | |
| WO | WO-2003104547 | A1 | 12/2003 | |
| WO | WO-2006037018 | A1 | 4/2006 | |
| WO | WO-2007028447 | A1 * | 3/2007 | F22B 37/56 |
| WO | WO-2008057039 | A1 | 5/2008 | |
| WO | WO-2009139714 | A1 | 11/2009 | |
| WO | WO-2010098946 | A2 | 9/2010 | |
| WO | WO-2014068325 | A1 | 5/2014 | |
| WO | WO-2020050050 | A1 | 3/2020 | |
| WO | WO-2021222707 | A1 | 11/2021 | |

OTHER PUBLICATIONS

Awad, Mostafa M.; Fouling of Heat Transfer Surfaces, Mansoura University; Jan. 28, 2011.

Kniewasser W et al: cleaning of HD ring pipelines and steam generators based on the new VGB guideline internal cleaning of sewage pipe steam generators//Cleaning of High-Pressure Cycle Piping and Steam Generators in Accordance With the New VGB Guideline Intern, VGB Powertech, Essen, DE, vol. 82. No. 1, issn 1435-3199. Jan. 1, 2002. pp. 57-62.

Korbee, R., et al.; Monitoring and Modelling of Gas-Side Boiler Fouling; ECI Symposium Series, vol. RP2: Proceedings of 6th International Conference on Heat Exchanger Fouling and Cleaning-Challenges and Opportunities; Jun. 5, 2005.

Valero, A., et al.; Ash Fouling in Coal-Fired Utility Boilers, Monitoring and Optimization of On-Load Cleaning; Prog. Energy Combust. Sci. vol. 22, pp. 189-200, 1996.

* cited by examiner

SYSTEM AND METHODS FOR CONTROLLING OPERATION OF A RECOVERY BOILER TO REDUCE FOULING

The invention relates to a computer-implemented method of reducing a rate of fouling in a recovery boiler system and a system configured to perform such a method.

SUMMARY

In some aspects, a system comprising a boiler, a fouling sensor, a boiler controller device, and an analysis computing device is provided. The fouling sensor is associated with a component of the boiler. The analysis computing device includes at least one processor and a computer-readable medium. The computer-readable medium has computer-executable instructions stored thereon that, in response to execution by the at least one processor, cause the analysis computing device to perform actions comprising receiving boiler operating information for a period of time, wherein the boiler operating information includes boiler operating parameters and a rate of fouling for the period of time; performing a regression analysis to determine at least one correlation between the boiler operating parameters and the rate of fouling; adjusting at least one boiler input parameter based on the at least one correlation to minimize the rate of fouling; and transmitting the at least one adjusted boiler input parameter to the boiler controller device for implementation.

In some aspects, a computer-implemented method of reducing a rate of fouling in a recovery boiler system is provided. A computing device receives boiler operating information for a period of time. The boiler operating information includes boiler operating parameters and a rate of fouling for the period of time. The boiler operating parameters include one or more boiler input parameters. The computing device performs a regression analysis to determine at least one correlation between the boiler operating parameters and the rate of fouling. The computing device causes at least one boiler input parameter to be adjusted based on the at least one correlation to minimize the rate of fouling.

In some aspects, a non-transitory computer-readable medium is provided. The medium has computer-executable instructions stored thereon that, in response to execution by one or more processors of a computing device, cause the computing device to perform actions comprising: receiving, by the computing device, boiler operating information for a period of time, wherein the boiler operating information includes boiler operating parameters and a rate of fouling for the period of time, and wherein the boiler operating parameters include one or more boiler input parameters; performing, by the computing device, a regression analysis to determine at least one correlation between the boiler operating parameters and the rate of fouling; and causing, by the computing device, at least one boiler input parameter to be adjusted based on the at least one correlation to minimize the rate of fouling.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
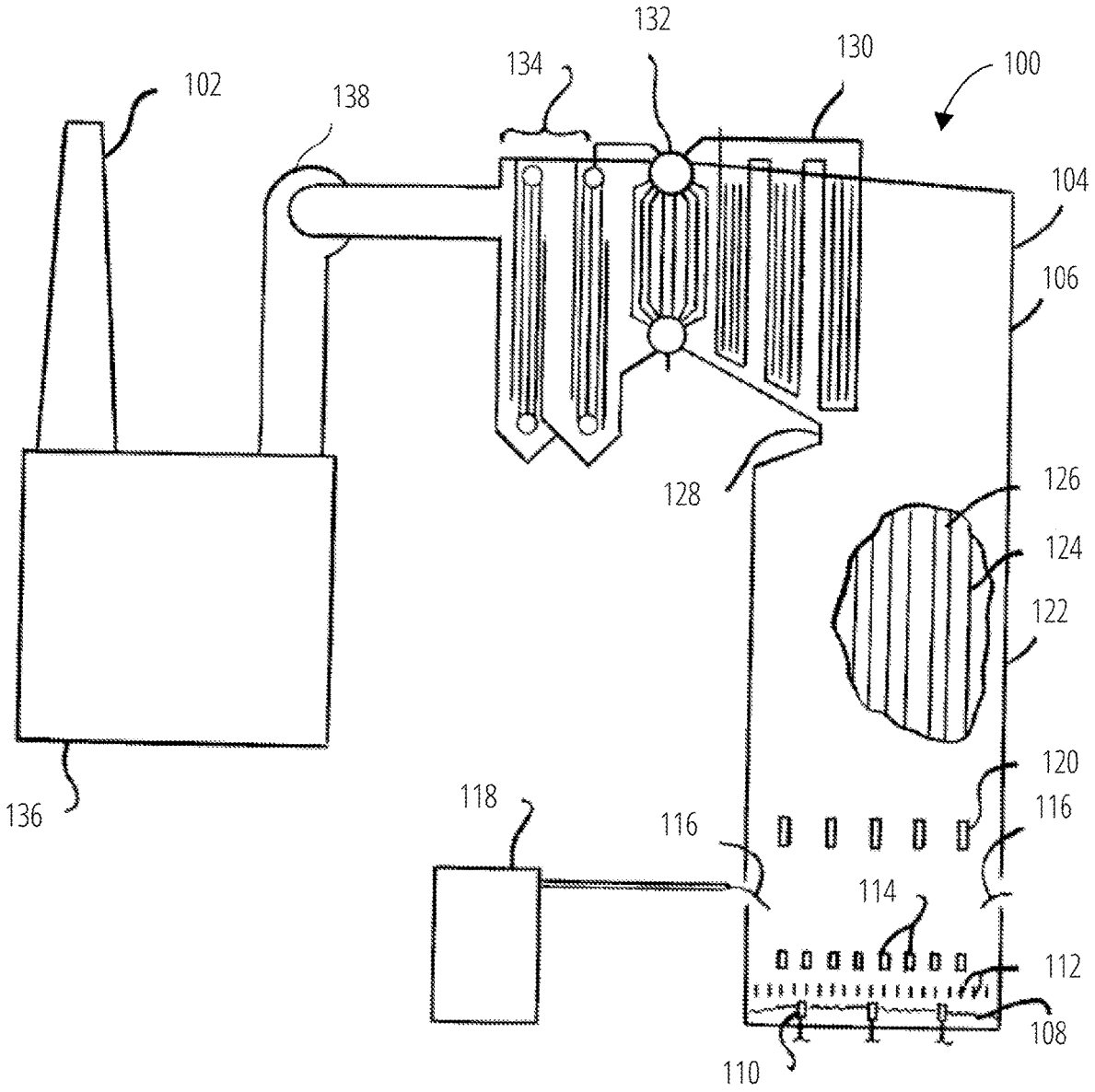
FIG. 1 diagrammatically shows the components of a non-limiting example aspect of a kraft black liquor recovery boiler system according to various aspects of the present disclosure.

In the paper-making process, chemical pulping yields, as a by-product, black liquor, which contains almost all of the inorganic cooking chemicals along with the lignin and other organic matter separated from the wood during pulping in a digester. The black liquor is burned in a recovery boiler. The two main functions of the recovery boiler are to recover the inorganic cooking chemicals used in the pulping process and to make use of the chemical energy in the organic portion of the black liquor to generate steam for a paper mill. The twin objectives of recovering both chemicals and energy make recovery boiler design and operation very complex.

In a kraft recovery boiler, superheaters are placed in the upper furnace in order to extract heat by radiation and convection from the furnace gases. Saturated steam enters the superheater section, and superheated steam exits at a controlled temperature. The superheater is constructed of an array of tube panels. The superheater surface is continually being fouled by ash that is being carried out of the furnace chamber. The amount of black liquor that can be burned in a kraft recovery boiler is often limited by the rate and extent of fouling on the surfaces of the superheater. This fouling reduces the heat absorbed from the liquor combustion, resulting in low exit steam temperatures from the superheaters and high gas temperatures entering the boiler. The boiler is shutdown for cleaning when either the exit steam temperature is too low for use in downstream equipment or the temperature entering the boiler bank exceeds the melting temperature of the deposits, resulting in gas side pluggage of the boiler bank. Kraft recovery boilers are particularly prone to the problem of superheater fouling, due to the high quantity of ash in the fuel (typically more than 35%) and the low melting temperature of the ash.

There are three conventional methods of removing deposits from the superheaters in kraft recovery boilers, listed in increasing order of required down-time and decreasing order of frequency: 1) sootblowing; 2) chill-and-blow; and 3) waterwashing.

Sootblowing is the process of blowing ash deposit off the superheater with a blast of steam from nozzles called sootblowers. Sootblowing occurs essentially continuously during normal boiler operation, with different sootblowers turned on at different times. Sootblowing reduces boiler efficiency, since 5-10% of the boiler's steam is typically used for sootblowing. Each sootblowing operation reduces a portion of the nearby ash deposit, but the ash deposit nevertheless continues to build up over time. As the deposit grows, sootblowing becomes gradually less effective and results in impairment of the heat transfer.

When the ash deposit reaches a certain threshold where boiler efficiency is significantly reduced and sootblowing is insufficiently effective, deposits are removed by the second cleaning process called "chill-and-blow" (also called "dry cleaning" because water is not used), requiring the partial or complete cessation of fuel firing in the boiler for typically 4-12 hours, but not complete boiler shutdown. During this time, the sootblowers continuously operate to cause the deposits to debond from the superheater sections and fall to the floor of the boiler. This procedure may be performed as often as every month, but the frequency can be reduced if the sootblowing is performed optimally (at the optimum schedule and in the optimum sequence). As with sootblowing, the chill-and-blow procedure reduces a portion of the nearby ash deposit, but the ash deposit nevertheless continues to grow over time. As the deposit grows, the chill-and-blow procedure becomes gradually less effective and must be performed more often.

The third cleaning process, waterwashing, entails complete boiler shutdown for typically two days, causing significant loss in pulping capacity at a mill. In a heavily fouled recovery boiler, it may be required every four months, but if the chill-and-blow process is properly timed (i.e. before large deposits form in the boiler bank section), then the shutdown and waterwashing can be avoided for even a year or longer.

As each of these cleaning processes reduces the efficiency of the boiler or entails shutdown of the boiler, it is clear that it is desirable to minimize the time spent during the cleaning processes. What is desired is an effective technique for adjusting operation of the boiler. This is maybe achieved in such a way that fouling of the boiler is minimized, and thereby the amount of time spent or parasitic energy used executing one or more of these cleaning processes is reduced.

FIG. 1 diagrammatically shows the components of a typical kraft black liquor recovery boiler system 100. Black liquor is a by-product of chemical pulping in the papermaking process. The initial concentration of "weak black liquor" is about 15%. It is concentrated to firing conditions (65% to 85% dry solids content) in an evaporator 118, and then burned in a recovery boiler 106.

The boiler 106 has a furnace section, or "furnace 122", where the black liquor is burned, and a convective heat transfer section 104, with a bullnose 128 in-between. Combustion converts the black liquor's organic material into gaseous products in a series of processes involving drying, devolatilizing (pyrolyzing, molecular cracking), and char burning/gasification. Some of the organics are converted to a solid carbon particulate called char. Burning of the char occurs largely on a char bed 108 which covers the floor of the furnace 122, though some char burns in flight. As carbon in the char is gasified or burned, the inorganic compounds in the char are released and form a molten salt mixture called smelt, which flows to the bottom of the char bed 108, and is continuously tapped from the furnace 122 through smelt spouts 110. Exhaust gases pass through an induced draft fan 138 and are filtered through an electrostatic precipitator 136, and exit through a stack 102.

The vertical walls 124 of the furnace are lined with vertically aligned wall tubes 126, through which water is evaporated utilizing the heat of the furnace 122. The furnace 122 has primary level air ports 112, secondary level air ports 114, and tertiary level air ports 120 for introducing air for combustion at three different height levels. Black liquor is sprayed into the furnace 122 out of black liquor black liquor guns 116.

The convective heat transfer section 104 contains the following three sets of tube banks (heat traps) which successively, in stages, heat the feedwater to superheated steam: 1) an economizer 134, in which the feedwater is heated to just below its boiling point, 2) the boiler bank 132 (or "steam generating bank"), in which, along with the wall tubes 126, the water is evaporated to steam, and 3) a superheater system 130, in which a series of parallel flow elements with intermediate headers is used to increase the steam temperature from saturation to the final superheat temperature.

Figure 2:
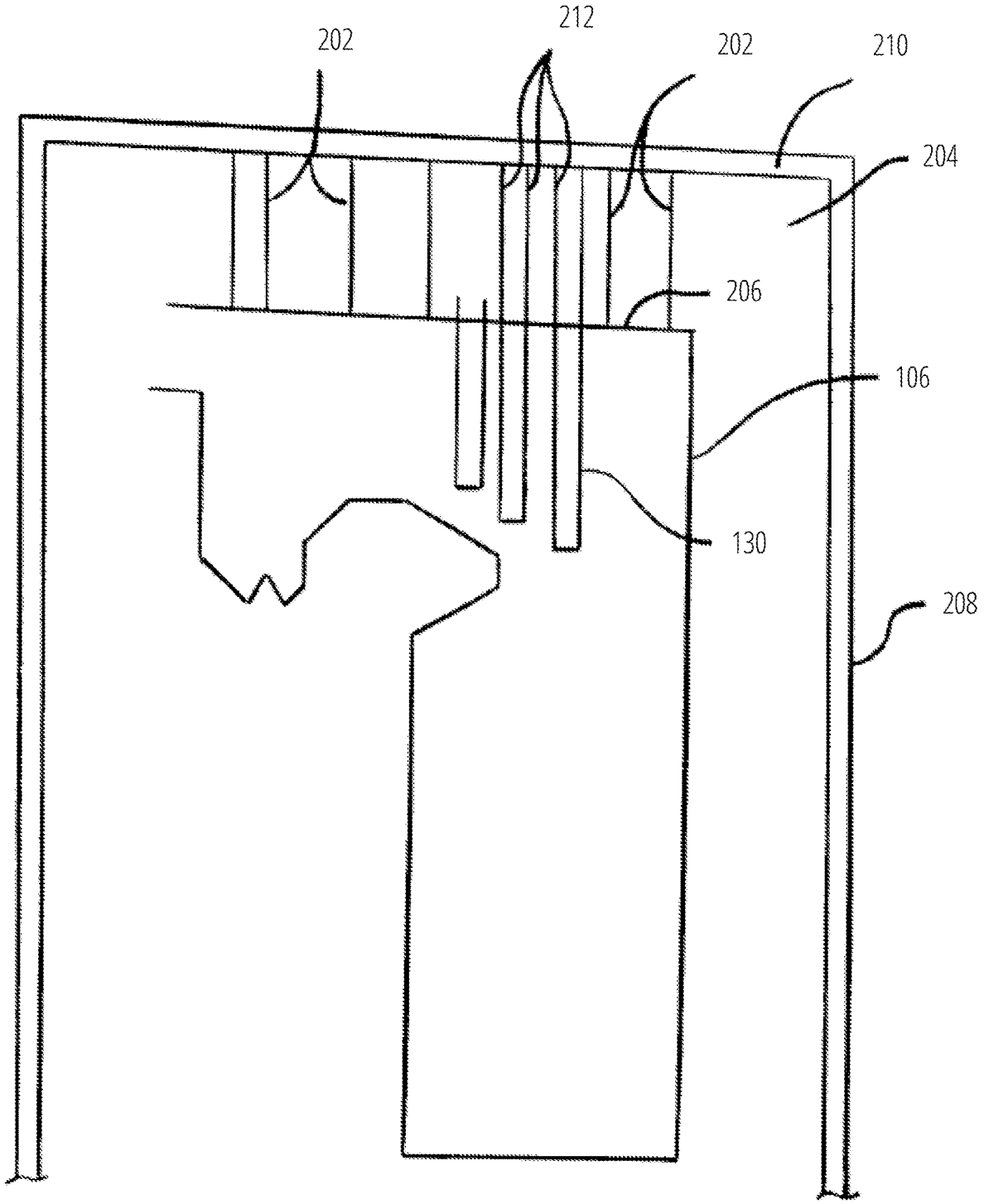
FIG. 2 diagrammatically illustrates how the recovery boiler is mounted in a steel beam support structure according to various aspects of the present disclosure.

FIG. 2 diagrammatically illustrates how the recovery boiler 106 is mounted in a steel beam support structure 208, showing only the boiler's profile and components that are of current interest. The entire recovery boiler 106 is suspended in the middle of the steel beam support structure 208 by boiler hanger rods 202. The boiler hanger rods 202 are connected between the roof 206 of the boiler 106 and the overhead beams 210 of the steel beam support structure 208. Another set of hanger rods, hereinafter called "superheater hanger rods" or simply "hanger rods 212", suspend only the superheater system 130. That is, the superheater system 130 is suspended independently from the rest of the boiler 106. The open-air area between the boiler roof 206 and the overhead beams 210 is called the penthouse 204.

Figure 3:
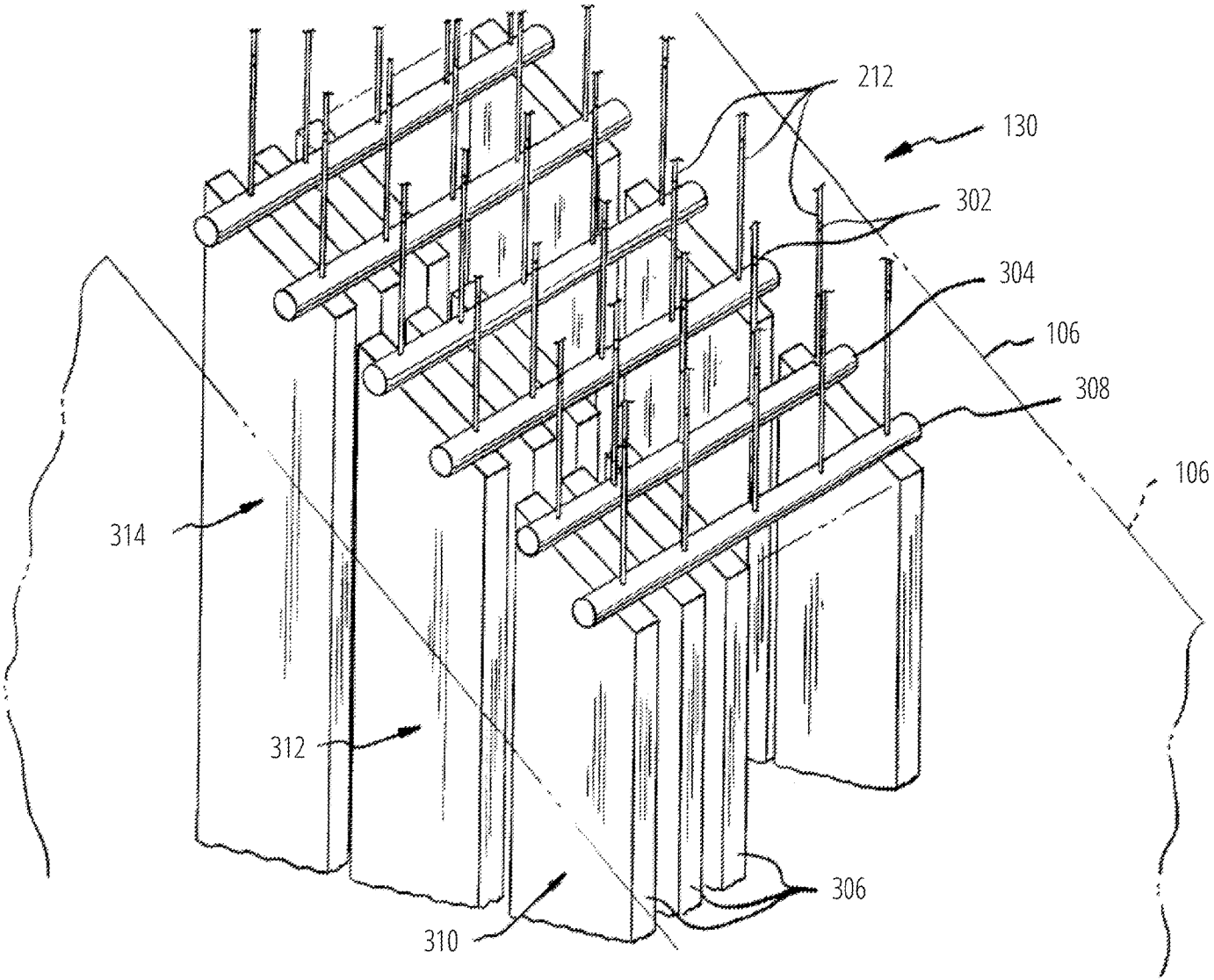
FIG. 3 diagrammatically illustrates some of the components of the superheater system which are independently suspended within the boiler according to various aspects of the present disclosure.

FIG. 3 diagrammatically illustrates some of the components of the superheater system 130 which are independently suspended within the boiler 106. The superheater system 130 in this aspect has three superheater platen 310, 312, 314. While three superheaters are shown, it is within the terms of the invention to incorporate more superheaters as needed. For clarity, the following discussion describes the construction of superheater platen 310 or speaks in terms of superheater platen 310, with the understanding that the construction of superheater platen 312 and superheater platen 314 is the same.

The superheater platen 310 has typically 20-50 platens 306. Steam enters the platens 306 through a manifold tube called an inlet header 308, is superheated within the platens, and exits the platens as superheated steam through another manifold tube called an outlet header 304. The platens 306 are suspended from the inlet header 308 and outlet header 304, which are themselves suspended from the overhead beams 210 (FIG. 2) by hanger rods 212. Typically 10-20 hanger rods 212 are evenly spaced along the length of each inlet header 308 and outlet header 304, affixed by conventional means, such as welding, to the header below and to the overhead beams 210 above, as described below. The superheater system 130 has typically 20 hanger rods 212—hanger rods for the inlet header 308 and 10 hanger rods for the outlet header 304. Each hanger rod has a threaded top around which a tension nut is turned to adjust the rod's tension. The tension of each hanger rod is adjusted typically after every 1-3 waterwashings to keep the tension uniform (balanced) among all the hanger rods 212 of a single superheater platen 310.

When clean (just after thorough waterwashing), each superheater platen 310 weighs typically 5000 kg, and each superheater hanger rod carries a load of typically 5000 kg. Subsequently, just before the next waterwashing is needed, deposits (fouling) add an additional weight on each superheater platen 310 of typically 2000 kg, resulting in an additional load on each hanger rod of typically 2000 kg, resulting in an additional strain on each hanger rod of typically $5.0\times10^{-5}$ cm/cm, which is measurable by commonly available methods, such as with a strain gage 302.

The strain (after zeroing off the strain that was read just after the previous waterwash), summed over all the hanger rods 212 suspending a superheater platen 310, is proportional to the weight of the deposit on that superheater. Each additional kg of deposit yields an additional strain of typically 2.0×10-8 cm/cm, which is measurable by strain sensors, such as strain gage 302. Hence, the weight of the deposit on each superheater platen 310 can be directly determined by measuring the strain on its corresponding hanger rods 212.

A typical system for determining deposit weight on a single superheater platen 310 might comprise twenty (20) strain gages affixed to the twenty (20) hanger rods 212, respectively, of the superheater, a computer having data acquisition capability (not shown) connected to the 60 strain gages, and a computer program. Under the program's control, the computer periodically (typically every minute) records strain readings from the 20 strain gages (from each superheater platen 310, 312, 314), calculates the sum of the strain readings, subtracts the sum of the strain readings taken just after a previous washdown, and then multiplies the result by a calibration factor to yield the current deposit weight.

In equation form, the formula is:

Deposit weight=(Sum of strain gage readings currently−Sum of strain gage readings just after a previous waterwash)×calibration factor;

or, equivalently stated:

$$\text{Deposit weight}=(\Sigma St-\Sigma So)\times C,$$

where

ΣSt=Sum of strain gage readings at any time t

ΣSo=Sum of strain gage readings just after a previous waterwash, considered as at time zero.

C=calibration constant to convert strain to weight.

While the strain gage 302 allows for the determination of the weight of the superheater platen 310, and this weight may be converted into an amount of fouling of the superheater platen 310, it is desirable to minimize the rate of fouling in order to extend the intervals between which dry cleaning and/or waterwashing is performed. The relationship between various boiler operating parameters and the rate of fouling is complex, so simple manual tuning of the boiler in order to minimize fouling is not efficient. What is desired are techniques for determining complex relationships between boiler operating parameters and the rate of fouling in order to determine boiler input parameters that will minimize the rate of fouling.

Figure 4:
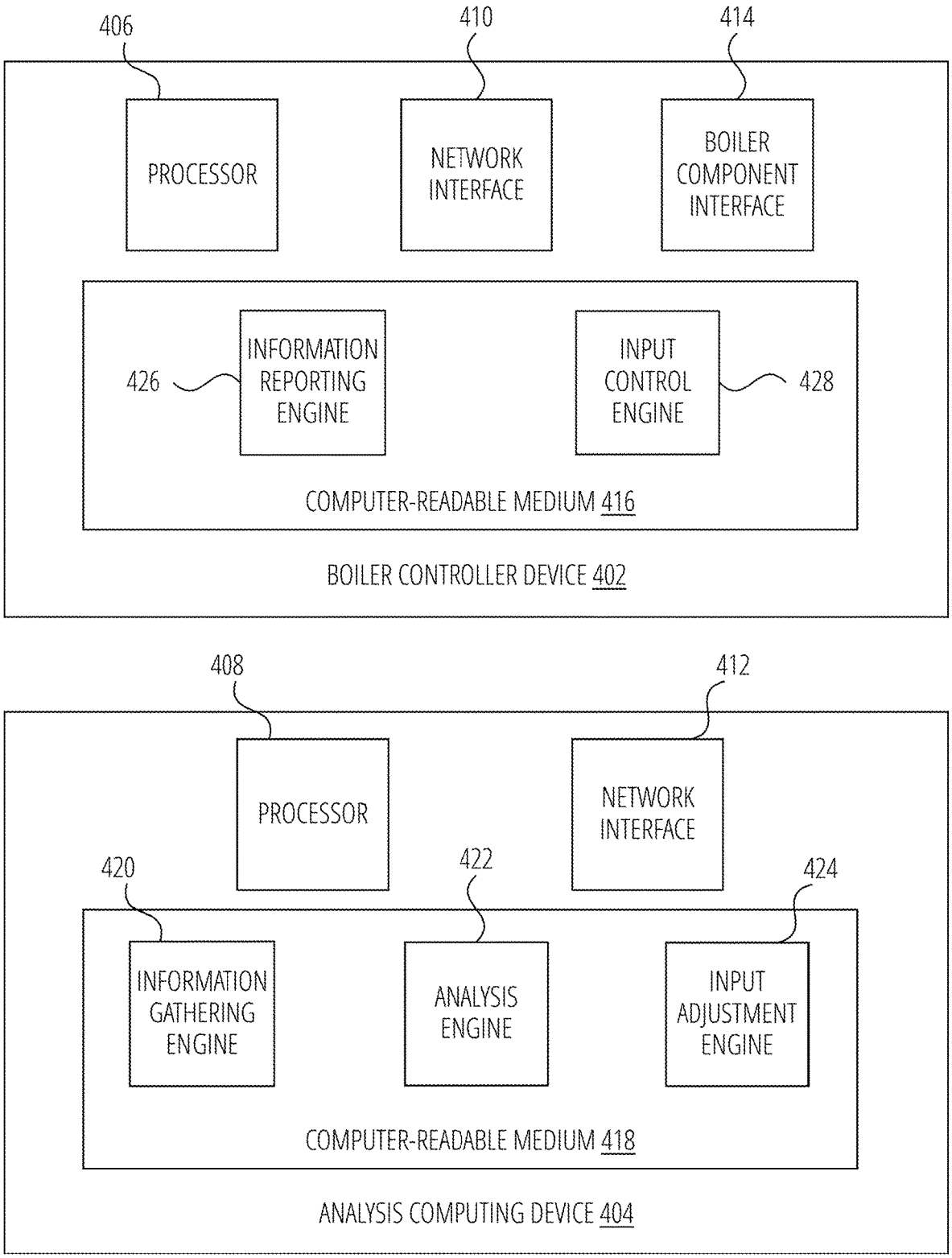
FIG. 4 is a block diagram that illustrates a non-limiting example aspect of computing device components of a recovery boiler system according to various aspects of the present disclosure.

FIG. 4 is a block diagram that illustrates a non-limiting example aspect of computing device components of a recovery boiler system according to various aspects of the present disclosure. As shown, the recovery boiler system may include a boiler controller device 402 and an analysis computing device 404. The boiler controller device 402 and the analysis computing device 404 can be used to determine boiler input parameters that will minimize the rate of fouling, and to implement those input parameters during operation of the recovery boiler system 100.

In some aspects, the boiler controller device 402 is a computing device that electronically controls one or more components of the recovery boiler system 100. In some aspects, the boiler controller device 402 may include an ASIC, an FPGA, or another customized computing device for controlling the components of the recovery boiler system 100. In some aspects, the boiler controller device 402 may include a computing device such as a desktop computing device, a laptop computing device, a server computing device, a mobile computing device, or any other type of computing device. In some aspects, more than one computing device may be used to collectively provide the functionality described as part of the boiler controller device 402.

As shown, the boiler controller device 402 includes at least one processor 406, a network interface 410, a boiler component interface 414, and a computer-readable medium 416. In some aspects, the network interface 410 may include any suitable communication technology for communicating with the analysis computing device 404, including but not limited to a wired communication technology (including but not limited to Ethernet, USB, and FireWire), a wireless communication technology (including but not limited to 2G, 3G, 4G, 5G, LTE, Bluetooth, ZigBee, Wi-Fi, and WiMAX), or combinations thereof. In some aspects, the boiler component interface 414 communicatively couples the boiler controller device 402 to one or more adjustable components of the recovery boiler system 100, including but not limited to the black liquor guns 116, the evaporator 118, the primary level air ports 112, the secondary level air ports 114, and the tertiary level air ports 120.

As shown, the computer-readable medium 416 includes logic that, in response to execution by the at least one processor 406, causes the boiler controller device 402 to provide an information reporting engine 426 and an input control engine 428. In some aspects, the information reporting engine 426 receives information from one or more components of the recovery boiler system 100, and transmits the information to the analysis computing device 404. In some aspects, the input control engine 428 receives commands from the analysis computing device 404, and adjusts the adjustable components of the recovery boiler system 100 based on the commands.

In some aspects, the analysis computing device 404 may include a computing device such as a desktop computing device, a laptop computing device, a mobile computing device, a server computing device, one or more computing devices of a cloud computing system, or any other type of computing device. In some aspects, more than one computing device may be used to collectively provide the functionality described as part of the analysis computing device 404.

As shown, the analysis computing device 404 includes at least one processor 408, a network interface 412, and a computer-readable medium 418. In some aspects, the network interface 412 may include any suitable communication technology for communicating with the network interface 410 of the boiler controller device 402.

As shown, the computer-readable medium 418 includes logic that, in response to execution by the at least one processor 408, causes the analysis computing device 404 to provide an information gathering engine 420, an analysis engine 422, and an input adjustment engine 424. In some aspects, the information gathering engine 420 receives information from at least the information reporting engine 426 of the boiler controller device 402. In some aspects, the analysis engine 422 analyzes the information gathered by the information reporting engine 426 in order to determine correlations between various boiler operating parameters and the rate of fouling. In some aspects, the input adjustment engine 424 uses the correlations determined by the analysis engine 422 in order to determine adjustments to one or more boiler input parameters, and transmits those adjustments to the boiler controller device 402 for implementation. Further details of the actions performed by each of these components are provided below.

"computer-readable medium" refers to a removable or nonremovable device that implements any technology capable of storing information in a volatile or non-volatile manner to be read by a processor of a computing device, including but not limited to: a hard drive; a flash memory; a solid state drive; random-access memory (RAM); read-only memory (ROM); a CD-ROM, a DVD, or other disk storage; a magnetic cassette; a magnetic tape; and a magnetic disk storage.

"engine" refers to logic embodied in hardware or software instructions, which can be written in a programming language, such as C, C++, COBOL, JAVA™, PHP, Perl, HTML, CSS, JavaScript, VBScript, ASPX, Microsoft .NET™, Go, Python, and/or the like. An engine may be compiled into executable programs or written in interpreted programming languages. Software engines may be callable from other engines or from themselves. Generally, the engines described herein refer to logical modules that can be merged with other engines, or can be divided into sub-engines. The engines can be implemented by logic stored in any type of computer-readable medium or computer storage device and be stored on and executed by one or more general purpose computers, thus creating a special purpose computer configured to provide the engine or the functionality thereof. The engines can be implemented by logic programmed into an application-specific integrated circuit (ASIC), a field-programmable gate array (FPGA), or another hardware device.

Figure 5:
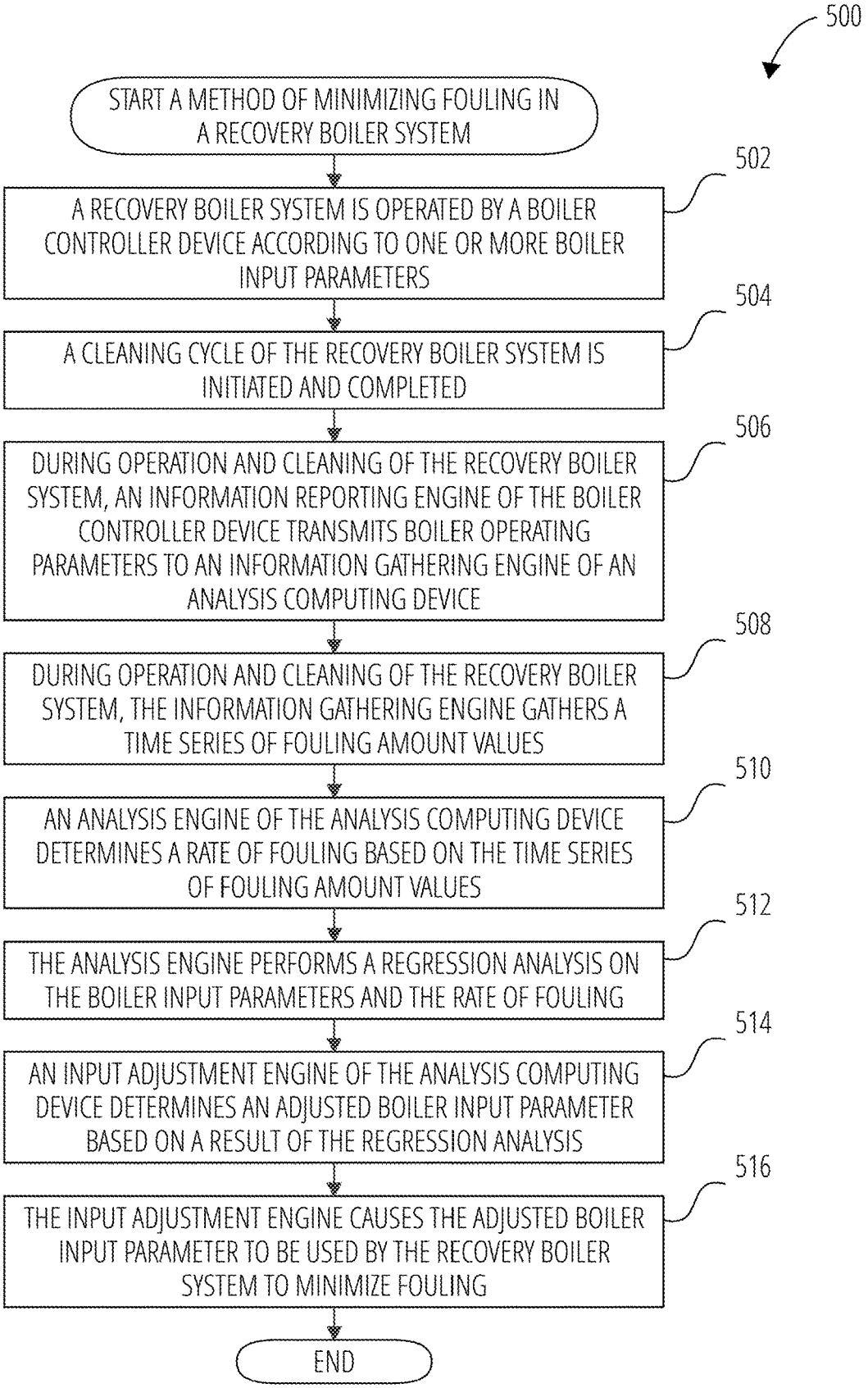
FIG. 5 is a flowchart that illustrates a non-limiting example aspect of a method for minimizing a rate of fouling of a recovery boiler system according to various aspects of the present disclosure.

FIG. 5 is a flowchart that illustrates a non-limiting example aspect of a method for minimizing a rate of fouling of a recovery boiler system according to various aspects of the present disclosure. In the method 500, at least one correlation between a boiler operating parameter and the rate of fouling is determined, such that the operation of the boiler can be automatically adjusted in order to minimize the rate of fouling.

From a start block, the method 500 proceeds to block 502, where a recovery boiler system 100 is operated by a boiler controller device 402 according to one or more boiler input parameters. In some aspects, the boiler input parameters may include any controllable aspect of operating the recovery boiler system 100. In some aspects, a chemical composition of the black liquor may be an example of a boiler input parameter. For example, a chloride content of the black liquor may have an affect on a rate of fouling. Accordingly, the chloride levels could be reduced by reducing the ash recovered from the electrostatic precipitator 136, or by utilizing various technologies that selectively remove the chloride from this ash and then recycle the clean ash to the weak black liquor. In some aspects, the types of make-up chemicals could be altered to reduce the amount of chloride in the black liquor. In some aspects, a technique used to spray the black liquor may be another example of a boiler input parameter. For example, the black liquor guns 116 may be adjustable via a liquor gun setting to spray the black liquor into the boiler 106 at different flow rates and/or at different droplet sizes.

In some aspects, a technique used to introduce air into the boiler may be another example of a boiler input parameter. For example, a setting may be adjusted in order to change the amount of air admitted by at least one of the primary level air ports 112, the secondary level air ports 114, and/or the tertiary level air ports 120, and/or to use the primary level air ports 112, the secondary level air ports 114, and/or the tertiary level air ports 120 to change air pressures in one or more locations within the boiler 106.

At block 504, a cleaning cycle of the recovery boiler system 100 is initiated and completed. In some aspects, the cleaning cycle of block 504 is being performed during operation of the recovery boiler system 100. As discussed above, a cleaning method usable during operation of the boiler 106 is sootblowing. Sootblowing may be performed by a plurality of sootblowers, which may not all be active at once. Accordingly, a "cleaning cycle" of sootblowing would include enough time such that all of the sootblowers have been activated at least once, and the entire boiler 106 has been cleaned at least once. By allowing a complete cleaning cycle to be completed, enough information will be collected to compensate for any short-term anomalies in the detected fouling rate due to unequal effectiveness of individual sootblowers. In some aspects, more than one cleaning cycle of the recovery boiler system 100 may be completed at block 504 while the recovery boiler system 100 is being operated.

At block 506, during operation and cleaning of the recovery boiler system 100, an information reporting engine 426 of the boiler controller device 402 transmits boiler operating parameters to an information gathering engine 420 of an analysis computing device 404. The time period for which the boiler operating parameters are transmitted includes at least the cleaning cycle described in block 504. In some aspects, the time period may include multiple weeks or multiple months.

In some aspects, the boiler operating parameters may include the boiler input parameters. In some aspects, the boiler operating parameters may also include other information regarding the operation of the recovery boiler system 100, including but not limited to temperatures of the boiler 106 in various locations, an amount of black liquor processed by the recovery boiler system 100, pressure drops through the heat transfer surfaces, and/or operating loads on the induced draft fan 138. In some aspects, the boiler operating parameters may include weight information generated by at least one strain gage 302. In some aspects, the boiler operating parameters may be provided as one or more time series of boiler operating parameter values.

At block 508, during operation and cleaning of the recovery boiler system 100, the information gathering engine 420 gathers a time series of fouling amount values. In some aspects, the information gathering engine 420 may extract the weight information received within the boiler operating parameters, and may determine the time series of fouling amount values by subtracting a tare weight of the elements suspended by the at least one strain gage 302 from each weight value. At block 510, an analysis engine 422 of the analysis computing device 404 determines a rate of fouling based on the time series of fouling amount values. In some aspects, the rate of fouling may be determined for each step in the time series, such that changes in the rate of fouling over time can be determined.

At block 512, the analysis engine 422 performs a regression analysis on the boiler input parameters and the rate of fouling. In some aspects, the regression analysis may be configured to detect correlations between changes in the boiler input parameters and changes in the rate of fouling. In some aspects, the regression analysis may detect correlations between single boiler input parameters and changes in the rate of fouling. In some aspects, the regression analysis may detect correlations between combinations of two or more boiler input parameters and changes in the rate of fouling. In some aspects, the regression analysis may also detect correlations between one or more boiler operating parameters other than the boiler input parameters and the changes in the rate of fouling, and/or may determine additional correlations between those boiler operating parameters and the boiler input parameters. For example, the regression analysis may detect a correlation between a boiler operating temperature and the rate of fouling, and an additional correlation between a liquor gun setting and the boiler operating temperature.

Any suitable regression analysis, including but not limited to a classification and regression tree (CART) analysis, may be used. In some aspects, CART analysis recursively partitions observations in a matched data set, comprising a categorical (for classification trees) or continuous (for regression trees) dependent (response) variable and one or more independent (explanatory) variables, into progressively smaller groups. Each partition may be a binary split. During each recursion, splits for each explanatory variable are examined and the split that maximizes the homogeneity of the two resulting groups with respect to the dependent variable is chosen. When examining boiler input parameters and the rate of fouling, one non-limiting example approach is to divide the behavior of the boiler into times of "low-fouling" and "high-fouling," and to develop a CART classification tree using the boiler input parameters to create homogenous groups that separate the low-fouling conditions from the high-fouling conditions. Ranges of the boiler input parameters that promote low-fouling conditions can then be selected as control ranges.

At block 514, an input adjustment engine 424 of the analysis computing device 404 determines an adjusted boiler input parameter based on a result of the regression analysis. For example, the input adjustment engine 424 may use a correlation between a liquor gun setting and the rate of fouling determined by the regression analysis to determine an adjustment to the liquor gun setting. As another example, the input adjustment engine 424 may use a correlation between settings for one or more air ports and the rate of fouling to determine an adjustment to one or more air ports. As yet another example, the input adjustment engine 424 may use a correlation between the chemistry of the black liquor and the rate of fouling to determine an adjustment to the chemistry. As still another example, the input adjustment engine 424 may use correlations of combined boiler input parameters with the rate of fouling to determine a combined optimal setting, or a combined optimal setting with one boiler input parameter (such as a chemistry) held constant, and may determine the adjusted boiler input parameters based on the combined optimal setting.

At block 516, the input adjustment engine 424 causes the adjusted boiler input parameter to be used by the recovery boiler system 100 to minimize fouling. In some aspects, the input adjustment engine 424 may cause the adjusted boiler input parameter to be automatically implemented by the recovery boiler system 100. For example, the input adjustment engine 424 may transmit the adjusted boiler input parameter to an input control engine 428 of the boiler controller device 402, and the input control engine 428 may automatically adjust the boiler input parameters to minimize fouling. In some aspects, such adjustment of the boiler input parameters may include transmitting a command to an actuator for the black liquor guns 116 or one or more air ports in order to change a setting on the black liquor guns 116 or one or more air ports. In some aspects, such adjustment of the boiler input parameters may include transmitting commands to actuators for valves controlling the amount of precipitator ash purged or sent to the ash cleaning system of the recovery boiler to reduce chloride levels. In some aspects, instead of causing the adjusted boiler input parameter to be automatically implemented, the input adjustment engine 424 may present the adjusted boiler input parameter to an operator, and the operator may create commands to change settings of components of the recovery boiler system 100 to adjust the boiler input parameter as presented.

The method 500 then proceeds to an end block and terminates.

Figure 6:
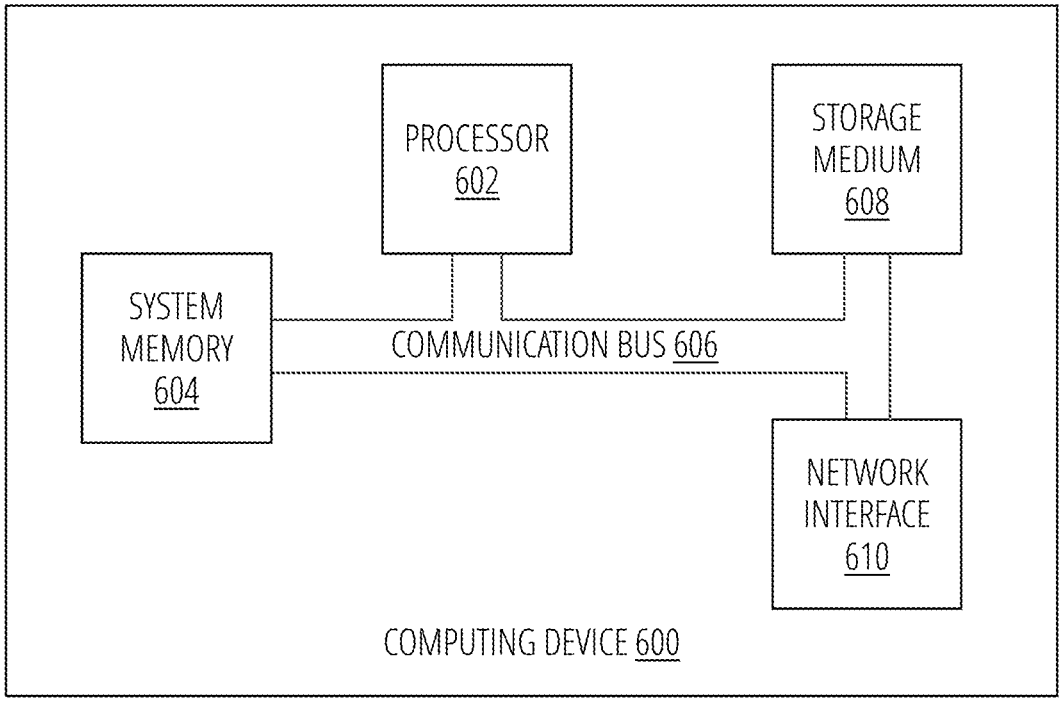
FIG. 6 is a block diagram that illustrates a non-limiting example aspect of a computing device appropriate for use as a computing device with aspects of the present disclosure.

FIG. 6 is a block diagram that illustrates aspects of an exemplary computing device 600 appropriate for use as a computing device of the present disclosure. While multiple different types of computing devices were discussed above, the exemplary computing device 600 describes various elements that are common to many different types of computing devices. While FIG. 6 is described with reference to a computing device that is implemented as a device on a network, the description below is applicable to servers, personal computers, mobile phones, smart phones, tablet computers, embedded computing devices, and other devices that may be used to implement portions of aspects of the present disclosure. Some aspects of a computing device may be implemented in or may include an application-specific integrated circuit (ASIC), a field-programmable gate array (FPGA), or other customized device. Moreover, those of ordinary skill in the art and others will recognize that the computing device 600 may be any one of any number of currently available or yet to be developed devices.

In its most basic configuration, the computing device 600 includes at least one processor 602 and a system memory 604 connected by a communication bus 606. Depending on the exact configuration and type of device, the system memory 604 may be volatile or nonvolatile memory, such as read only memory ("ROM"), random access memory ("RAM"), EEPROM, flash memory, or similar memory technology. Those of ordinary skill in the art and others will recognize that system memory 604 typically stores data and/or program modules that are immediately accessible to and/or currently being operated on by the processor 602. In this regard, the processor 602 may serve as a computational center of the computing device 600 by supporting the execution of instructions.

As further illustrated in FIG. 6, the computing device 600 may include a network interface 610 comprising one or more components for communicating with other devices over a network. Aspects of the present disclosure may access basic services that utilize the network interface 610 to perform communications using common network protocols. The network interface 610 may also include a wireless network interface configured to communicate via one or more wireless communication protocols, such as Wi-Fi, 2G, 3G, LTE, WiMAX, Bluetooth, Bluetooth low energy, and/or the like. As will be appreciated by one of ordinary skill in the art, the network interface 610 illustrated in FIG. 6 may represent one or more wireless interfaces or physical communication interfaces described and illustrated above with respect to particular components of the computing device 600.

In the exemplary aspect depicted in FIG. 6, the computing device 600 also includes a storage medium 608. However, services may be accessed using a computing device that does not include means for persisting data to a local storage medium. Therefore, the storage medium 608 depicted in FIG. 6 is represented with a dashed line to indicate that the storage medium 608 is optional. In any event, the storage medium 608 may be volatile or nonvolatile, removable or nonremovable, implemented using any technology capable of storing information such as, but not limited to, a hard drive, solid state drive, CD ROM, DVD, or other disk storage, magnetic cassettes, magnetic tape, magnetic disk storage, and/or the like.

Suitable implementations of computing devices that include a processor 602, system memory 604, communication bus 606, storage medium 608, and network interface 610 are known and commercially available. For ease of illustration and because it is not important for an understanding of the claimed subject matter, FIG. 6 does not show some of the typical components of many computing devices. In this regard, the computing device 600 may include input devices, such as a keyboard, keypad, mouse, microphone, touch input device, touch screen, tablet, and/or the like. Such input devices may be coupled to the computing device 600 by wired or wireless connections including RF, infrared, serial, parallel, Bluetooth, Bluetooth low energy, USB, or other suitable connections protocols using wireless or physical connections. Similarly, the computing device 600 may also include output devices such as a display, speakers, printer, etc. Since these devices are well known in the art, they are not illustrated or described further herein.

In the foregoing description numerous specific details are set forth to provide a thorough understanding of the aspects. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

The order in which some or all of the process blocks appear in each process should not be deemed limiting. Rather, one of ordinary skill in the art having the benefit of the present disclosure will understand that some of the process blocks may be executed in a variety of orders not illustrated, or even in parallel.

The above description of illustrated aspects of the invention, including what is described in the Abstract, is not intended to be exhaustive or to limit the invention to the precise forms disclosed. While specific aspects of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific aspects disclosed in the specification. Rather, the scope of the invention is to be determined entirely by the following claims, which are to be construed in accordance with established doctrines of claim interpretation.

In general, the invention describes:

A system, comprising a boiler; a fouling sensor associated with a component of the boiler; a boiler controller device; and an analysis computing device that includes at least one processor and a computer-readable medium having computer-executable instructions stored thereon that, in response to execution by the at least one processor, cause the analysis computing device to perform actions comprising: receiving boiler operating information for a period of time, wherein the boiler operating information includes boiler operating parameters and a rate of fouling for the period of time, and wherein the boiler operating parameters include one or more boiler input parameters; performing a regression analysis to determine at least one correlation between the boiler operating parameters and the rate of fouling; adjusting at least one boiler input parameter based on the at least one correlation to minimize the rate of fouling; and transmitting the at least one adjusted boiler input parameter to the boiler controller device for implementation and/or preferably, wherein the boiler includes a heat exchange element, and wherein the fouling sensor is associated with the heat exchange element and/or preferably wherein the fouling sensor is a weight sensor configured to generate values indicating a weight of the heat exchange element and/or preferably wherein receiving the rate of fouling for the period of time includes: receiving a time series of fouling amount values; and determining the rate of fouling based on the time series of fouling amount values and/or preferably wherein performing the regression analysis to determine the at least one correlation between the boiler operating parameters and the rate of fouling includes performing a CART analysis on the boiler operating information and/or preferably further comprising one or more sootblowers configured to operate according to a cycle, and wherein receiving boiler operating information for the period of time includes receiving boiler operating information for a period of time that includes at least one complete cycle and/or preferably further comprising: one or more valves configured to control an amount of precipitator ash purged or sent to an ash cleaning system in order to affect a chloride level; and one or more actuators configured to control the one or more valves; wherein the at least one boiler input parameter includes a valve setting; wherein transmitting the at least one adjusted boiler input parameter to the boiler controller device for implementation includes transmitting the valve setting to the one or more actuators; and wherein the one or more actuators are configured to adjust the one or more valves based on the valve setting; and/or preferably further comprising one or more liquor guns, wherein the at least one boiler input parameter includes a liquor gun setting, wherein transmitting the at least one adjusted boiler input parameter to the boiler controller device for implementation includes transmitting the liquor gun setting to the boiler controller device, and wherein the boiler controller device is configured to change operation of the one or more liquor guns based on the liquor gun setting and/or preferably further comprising one or more air ports, wherein the at least one boiler input parameter includes settings for one or more air ports, wherein transmitting the at least one adjusted boiler input parameter to the boiler controller device for implementation includes transmitting adjusted settings for one or more air ports to the boiler controller device, and wherein the boiler controller device is configured to change operation of the one or more air ports based on the adjusted settings for the one or more air ports.

A computer-implemented method of reducing a rate of fouling in a recovery boiler system, the method comprising: receiving, by a computing device, boiler operating information for a period of time, wherein the boiler operating information includes boiler operating parameters and a rate of fouling for the period of time, and wherein the boiler operating parameters include one or more boiler input parameters; performing, by the computing device, a regression analysis to determine at least one correlation between the boiler operating parameters and the rate of fouling; and causing, by the computing device, at least one boiler input parameter to be adjusted based on the at least one correlation to minimize the rate of fouling and/or preferably wherein receiving the rate of fouling for the period of time includes: receiving, by the computing device, a time series of fouling amount values; and determining, by the computing device, the rate of fouling based on the time series of fouling amount values; and/or preferably wherein receiving the time series of fouling amount values includes receiving the time series of fouling amount values from a weight sensor configured to weigh a heat exchange element and/or preferably wherein performing the regression analysis to determine the at least one correlation between the boiler operating parameters and the rate of fouling includes performing a CART analysis on the boiler operating information and/or preferably wherein the recovery boiler system includes one or more sootblowers configured to operate according to a cycle, and wherein receiving boiler operating information for the period of time includes receiving boiler operating information for a period of time that includes at least one complete cycle and/or preferably wherein causing the at least one boiler input parameter to be adjusted based on the at least one correlation to minimize the rate of fouling includes at least one of causing a chemistry of boiler inputs to be adjusted, causing a liquor gun setting to be adjusted, and causing settings for one or more air ports to be adjusted.

A non-transitory computer-readable medium having computer-executable instructions stored thereon that, in response to execution by one or more processors of a computing device, cause the computing device to perform actions comprising: receiving, by the computing device, boiler operating information for a period of time, wherein the boiler operating information includes boiler operating parameters and a rate of fouling for the period of time, and wherein the boiler operating parameters include one or more boiler input parameters; performing, by the computing device, a regression analysis to determine at least one correlation between the boiler operating parameters and the rate of fouling; and causing, by the computing device, at least one boiler input parameter to be adjusted based on the at least one correlation to minimize the rate of fouling, and/or preferably wherein receiving the rate of fouling for the period of time includes: receiving, by the computing device, a time series of fouling amount values; and determining, by the computing device, the rate of fouling based on the time series of fouling amount values and/or preferably wherein performing the regression analysis to determine the at least one correlation between the boiler operating parameters and the rate of fouling includes performing a CART analysis on the boiler operating information and/or preferably wherein the recovery boiler system includes one or more sootblowers configured to operate according to a cycle, and wherein receiving boiler operating information for a period of time includes receiving boiler operating information for a period of time that includes at least one complete cycle and/or preferably wherein causing the at least one boiler input parameter to be adjusted based on the at least one correlation to minimize the rate of fouling includes at least one of causing a chemistry of boiler inputs to be adjusted, causing a liquor gun setting to be adjusted, and causing settings for one or more air ports to be adjusted.

What is claimed is:

1. A system, comprising:

a boiler;

a fouling sensor associated with a component of the boiler;

a boiler controller device; and an analysis computing device that includes at least one processor and a computer readable medium having computer-executable instructions stored thereon that, in response to execution by the at least one processor, cause the analysis computing device to perform actions for minimizing a rate of fouling and thereby reducing an amount of time spent executing cleaning processes, the actions comprising:

receiving boiler operating information for a period of time, wherein the boiler operating information includes a plurality of boiler operating parameters and a rate of fouling for the period of time, and wherein the plurality of boiler operating parameters include a plurality of boiler input parameters;

performing a regression analysis to determine at least one correlation between a combination of two or more of the plurality of boiler operating parameters and the rate of fouling, wherein the combination of the two or more of the plurality of boiler operating parameters includes at least one boiler input parameter;

adjusting the at least one boiler input parameter based on the at least one correlation to minimize the rate of fouling; and transmitting the at least one adjusted boiler input parameter to the boiler controller device for implementation.

2. The system of claim 1, wherein the boiler includes a heat exchange element, and wherein the fouling sensor is associated with the heat exchange element.

3. The system of claim 2, wherein the fouling sensor is a weight sensor configured to generate values indicating a weight of the heat exchange element.

4. The system of claim 1, wherein receiving the rate of fouling for the period of time includes:

receiving a time series of fouling amount values; and determining the rate of fouling based on the time series of fouling amount values.

5. The system of claim 1, wherein performing the regression analysis to determine the at least one correlation between the plurality of boiler operating parameters and the rate of fouling includes performing a CART analysis on the boiler operating information, wherein performing the CART analysis includes:

dividing the boiler operating information into one or more low-fouling periods and one or more high-fouling periods; and developing a CART classification tree using at least the boiler input parameters to separate the low-fouling periods from the high-fouling periods.

6. The system of claim 1, further comprising one or more sootblowers configured to operate according to a cycle, and wherein receiving boiler operating information for the period of time includes receiving boiler operating information for a period of time that includes at least one complete cycle.

7. The system of claim 1, further comprising:

an electrostatic precipitator;

one or more valves configured to control an amount of precipitator ash from the electrostatic precipitator that is purged or sent to an ash cleaning system in order to affect a chloride level; and one or more actuators configured to control the one or more valves;

wherein the at least one boiler input parameter includes a valve setting;

wherein transmitting the at least one adjusted boiler input parameter to the boiler controller device for implementation includes transmitting the valve setting to the one or more actuators; and wherein the one or more actuators are configured to adjust the one or more valves based on the valve setting.

8. The system of claim 1, further comprising one or more liquor guns, wherein the plurality of boiler input parameters includes a liquor gun setting, wherein transmitting the at least one adjusted boiler input parameter to the boiler controller device for implementation includes transmitting the liquor gun setting to the boiler controller device, and wherein the boiler controller device is configured to change operation of the one or more liquor guns based on the liquor gun setting.

9. The system of claim 1, further comprising one or more air ports, wherein the plurality of boiler input parameters includes settings for one or more air ports, wherein transmitting the at least one adjusted boiler input parameter to the boiler controller device for implementation includes transmitting adjusted settings for one or more air ports to the boiler controller device, and wherein the boiler controller device is configured to change operation of the one or more air ports based on the adjusted settings for the one or more air ports.

10. A computer-implemented method of reducing a rate of fouling in a recovery boiler system and thereby reducing an amount of time spent executing cleaning processes, the method comprising:

receiving, by a computing device, boiler operating information for a period of time, wherein the boiler operating information includes a plurality of boiler operating parameters and a rate of fouling for the period of time, and wherein the plurality of boiler operating parameters include a plurality of boiler input parameters;

performing, by the computing device, a regression analysis to determine at least one correlation between a combination of two or more of the plurality of boiler operating parameters and the rate of fouling, wherein the combination of the two or more of the plurality of boiler operating parameters includes at least one boiler input parameter;

causing, by the computing device, the at least one boiler input parameter to be adjusted based on the at least one correlation to minimize the rate of fouling; and transmitting, by the computing device, the at least one adjusted boiler input parameter to a boiler controller device for implementation.

11. The computer-implemented method of claim 10, wherein receiving the rate of fouling for the period of time includes:

receiving, by the computing device, a time series of fouling amount values; and determining, by the computing device, the rate of fouling based on the time series of fouling amount values.

12. The computer-implemented method of claim 11, wherein receiving the time series of fouling amount values includes receiving the time series of fouling amount values from a weight sensor configured to weigh a heat exchange element.

13. The computer-implemented method of claim 10, wherein performing the regression analysis to determine the at least one correlation between the plurality of boiler operating parameters and the rate of fouling includes performing a CART analysis on the boiler operating information, wherein performing the CART analysis includes:

dividing the boiler operating information into one or more low-fouling periods and one or more high-fouling periods; and developing a CART classification tree using at least the boiler input parameters to separate the low-fouling periods from the high-fouling periods.

14. The computer-implemented method of claim 10, wherein the recovery boiler system includes one or more sootblowers configured to operate according to a cycle, and wherein receiving boiler operating information for the period of time includes receiving boiler operating information for a period of time that includes at least one complete cycle.

15. The computer-implemented method of claim 10, wherein causing the at least one boiler input parameter to be adjusted based on the at least one correlation to minimize the rate of fouling includes at least one of causing a chemistry of boiler inputs to be adjusted, causing a liquor gun setting to be adjusted, and causing settings for one or more air ports to be adjusted.

16. A non-transitory computer-readable medium having computer-executable instructions stored thereon that, in response to execution by one or more processors of a computing device, cause the computing device to perform actions for minimizing a rate of fouling in a recovery boiler and thereby reducing an amount of time spent executing cleaning processes, the actions comprising:

receiving, by the computing device, boiler operating information for a period of time, wherein the boiler operating information includes a plurality of boiler operating parameters and a rate of fouling for the period of time, and wherein the plurality of boiler operating parameters include a plurality of boiler input parameters;

performing, by the computing device, a regression analysis to determine at least one correlation between a combination of two or more of the plurality of boiler operating parameters and the rate of fouling, wherein the combination of the two or more of the plurality of boiler operating parameters includes at least one boiler input parameter;

causing, by the computing device, at least one boiler input parameter to be adjusted based on the at least one correlation to minimize the rate of fouling; and transmitting, by the computing device, the at least one adjusted boiler input parameter to a boiler controller device for implementation.

17. The computer-readable medium of claim 16, wherein receiving the rate of fouling for the period of time includes:

receiving, by the computing device, a time series of fouling amount values; and determining, by the computing device, the rate of fouling based on the time series of fouling amount values.

18. The computer-readable medium of claim 16, wherein performing the regression analysis to determine the at least one correlation between the plurality of boiler operating parameters and the rate of fouling includes performing a CART analysis on the boiler operating information, wherein performing the CART analysis includes:

dividing the boiler operating information into one or more low-fouling periods and one or more high-fouling periods; and developing a CART classification tree using at least the boiler input parameters to separate the low-fouling periods from the high-fouling periods.

19. The computer-readable medium of claim 16, wherein the recovery boiler system includes one or more sootblowers configured to operate according to a cycle, and wherein receiving boiler operating information for a period of time includes receiving boiler operating information for a period of time that includes at least one complete cycle.

20. The computer-readable medium of claim 16, wherein causing the at least one boiler input parameter to be adjusted based on the at least one correlation to minimize the rate of fouling includes at least one of causing a chemistry of boiler inputs to be adjusted, causing a liquor gun setting to be adjusted, and causing settings for one or more air ports to be adjusted.

* * * * *